US009163434B2

(12) United States Patent
Uehara et al.

(10) Patent No.: US 9,163,434 B2
(45) Date of Patent: Oct. 20, 2015

(54) VEHICLE DOOR LOCK APPARATUS

(71) Applicant: ANSEI CORPORATION, Obu-shi (JP)

(72) Inventors: Hiroki Uehara, Nagoya (JP); Masaya Okuyama, Nagoya (JP)

(73) Assignee: ANSEI CORPORATION, Obu-shi (JP)

( * ) Notice: Subject to any disclaimer, the term of this patent is extended or adjusted under 35 U.S.C. 154(b) by 46 days.

(21) Appl. No.: 14/204,571

(22) Filed: Mar. 11, 2014

(65) Prior Publication Data

US 2014/0319847 A1 Oct. 30, 2014

(30) Foreign Application Priority Data

Apr. 24, 2013 (JP) ..... 2013-090823

(51) Int. Cl.

| | |
|---|---|
| ***E05C 19/10*** | (2006.01) |
| ***E05B 77/26*** | (2014.01) |
| ***E05B 81/20*** | (2014.01) |
| *E05B 79/20* | (2014.01) |
| *E05B 81/06* | (2014.01) |
| *E05B 81/36* | (2014.01) |

(52) U.S. Cl.

CPC ..... *E05B 77/26* (2013.01); *E05B 77/265* (2013.01); *E05B 81/20* (2013.01); *E05B 79/20* (2013.01); *E05B 81/06* (2013.01); *E05B 81/36* (2013.01); *Y10T 292/0946* (2015.04)

(58) Field of Classification Search

USPC ..... 292/97, 216, DIG. 23, 201

See application file for complete search history.

(56) References Cited

U.S. PATENT DOCUMENTS

| | | | | | |
|---|---|---|---|---|---|
| 4,986,579 | A | * | 1/1991 | Ishikawa | 292/201 |
| 5,427,421 | A | * | 6/1995 | Hamaguchi | 292/216 |
| 5,454,607 | A | * | 10/1995 | Ishihara et al. | 292/201 |
| 5,951,069 | A | * | 9/1999 | Kobayashi et al. | 292/201 |
| 6,131,337 | A | * | 10/2000 | Machida | 49/280 |

(Continued)

FOREIGN PATENT DOCUMENTS

| | | | |
|---|---|---|---|
| JP | 2001182405 | A | 7/2001 |
| JP | 2008240393 | A | 10/2008 |
| JP | 2010037723 | A | 2/2010 |

OTHER PUBLICATIONS

Office Action from the Japanese Patent Office dated Jul. 28, 2015 in counterpart Japanese application No. 2013-090823, and translation thereof.

*Primary Examiner* — Mark Williams

(74) *Attorney, Agent, or Firm* — J-Tek Law PLLC; Jeffrey D. Tekanic; Scott T. Wakeman

(57) ABSTRACT

A closing mechanism of a vehicle door lock apparatus includes a drive, a pivoting body, a close lever, a transmitting member, and a cancel lever. The pivoting body is driven by the drive to pivot when a fork is disposed in a half latched position. The transmitting member is displaceable between an engaging position, where the transmitting member regulates relative displacement of the close lever and the pivoting body, and a releasing position where the transmitting member allows relative displacement. The cancel lever pivots independently of an open lever and displaces the transmitting member to the releasing position. The close lever displaces the fork to a latched position through the pivoting of the pivoting body when the transmitting member is in the engaging position. The close lever does not contact the fork irrespective of the pivoting of the pivoting body when the transmitting member is in the releasing position.

8 Claims, 10 Drawing Sheets

(56) References Cited

U.S. PATENT DOCUMENTS 6,145,254 A * 11/2000 Silva ..... 52/66
7,770,946 B2 * 8/2010 Kouzuma ..... 292/201
2001/0005079 A1 6/2001 Takamura
2005/0099016 A1 * 5/2005 Inoue ..... 292/216
2007/0075552 A1 * 4/2007 Hayakawa et al. ..... 292/216
2009/0051173 A1 * 2/2009 Akizuki et al. ..... 292/216

* cited by examiner

VEHICLE DOOR LOCK APPARATUS

CROSS-REFERENCE

The present patent application claims priority to Japanese patent application no. 2013-090823, filed on Apr. 24, 2013, the contents of which are entirely incorporated herein by reference.

TECHNICAL FIELD

The present invention relates to a vehicle door lock apparatus.

BACKGROUND ART

Japanese Patent No. 5107170 discloses a known vehicle door lock apparatus that includes a base member, a fork, a pawl, an open lever, and a closing mechanism.

The base member is provided in a door and includes an entry opening configured to receive a striker fixed to a vehicle body. The fork is provided in the base member. The fork is displaceable to a latched position, where the fork locks the striker on the depth side of the entry opening, to a half latched position, where the fork locks the striker halfway in the entry opening, and to an unlatched position where the fork does not lock the striker in the entry opening. The pawl is provided in the base member. The pawl is capable of fixing or allowing the displacement of the fork. The open lever is pivotably supported about a first axis by the base member. The open lever acts on the pawl in connection with an opening operation of a door handle and allows the displacement of the fork. The closing mechanism acts on the fork when the fork is disposed in the half latched position and displaces the fork to the latched position.

More specifically, the locking mechanism includes a driving source, a pivoting body, a close lever, a transmitting member, and a cancel lever. The driving source generates a driving force. The pivoting body is pivotably supported by the base member about a second axis parallel to the first axis. When the fork is disposed in the half latched position, the pivoting body is driven by the driving source to pivot. The close lever is pivotably supported by the pivoting body about a third axis that is coaxial with the second axis. The transmitting member is provided in the pivoting body. The transmitting member is displaceable between an engaging position, where the transmitting member engages with the close lever and regulates relative displacement of the close lever and the pivoting body, and a releasing position where the close lever stops engaging with the close lever and allows the relative displacement of the close lever and the pivoting body. The cancel lever and the open lever are one (integral) member. The cancel lever pivots integrally with the open lever in connection with the opening operation of the door handle and displaces the transmitting member from the engaging position to the releasing position.

In this known vehicle door lock apparatus, when the fork is displaced from the unlatched position to the half latched position while the door is closed, the closing mechanism operates and the pivoting body is driven by the driving source to pivot. At that point, if the opening operation for the door handle is not performed, the cancel lever does not pivot and the transmitting member is disposed in the engaging position. Therefore, since the transmitting member regulates the relative displacement of the close lever and the pivoting body, the close lever comes into contact with the fork disposed in the half latched position through the pivoting of the pivoting body and displaces the fork to the latched position. In this way, it is possible to automatically close the door by using the known vehicle door lock apparatus.

On the other hand, when the opening operation for the door handle is performed while the closing mechanism operates to close the door and displaces the fork from the half latched position to the latched position, the cancel lever pivots in connection with the opening operation and displaces the transmitting member to the releasing position. Therefore, since the transmitting member allows the relative displacement of the close lever and the pivoting body, the close lever stops coming into contact with the fork irrespective of the pivoting of the pivoting body. As a result, the known vehicle door lock apparatus makes it possible to stop the operation for closing the door by the closing mechanism.

SUMMARY

It is further noted that some vehicle doors include a disabling mechanism, such as a child lock mechanism and/or a lock/unlock mechanism, provided between the door handle and the open lever. The disabling mechanism selectively prohibits operation (connection) of the open lever with the opening operation of the door handle. It is conceivable to selectively prohibit, in the above-described known vehicle door lock apparatus, the operation (connection) of the open lever with the opening operation of the door handle by using such a disabling mechanism.

However, in such a hypothetical modification of the known vehicle door lock apparatus, since the open lever and the cancel lever are a single (integral) member, when the operation (connection) of the open lever with the opening operation of the door handle is prohibited by the disabling mechanism, the cancel lever also would stop pivoting in connection with the opening operation. Therefore, in case the operation (connection) of the open lever is prohibited by the disabling mechanism and the opening operation of the door handle is performed while the closing mechanism operates to close the door and displaces the fork from the half latched position to the latched position, then the cancel lever cannot displace the transmitting member from the engaging position to the releasing position, and the operation for closing the door by the closing mechanism continues. Therefore, such a vehicle door lock apparatus would require additional safety improvements during the operation of the closing mechanism.

The present techniques have been devised in view of these circumstances. In particular, in one aspect of the present disclosure, a vehicle door lock apparatus is provided that can improve (increase) safety during the operation of a closing mechanism.

In another aspect of the present disclosure, a vehicle door lock apparatus preferably includes: a base member configured to be provided in or on one of a door and a vehicle body, the base member including an entry opening configured to receive a striker fixed to the other of the door and the vehicle body. A fork is provided in or on the base member and is displaceable to a latched position, where the fork locks the striker on the depth (bottom) side of the entry opening, to a half latched position, where the fork locks the striker halfway in the entry opening, and to an unlatched position, where the fork does not lock the striker in the entry opening. A pawl is provided in or on the base member and is capable of fixing or allowing the displacement of the fork. An open lever is pivotably supported about a first axis by the base member. The open lever acts on the pawl in connection with an opening operation of a door handle and allows the displacement of the fork. A closing mechanism is configured to act on the fork when it is disposed in the half latched position and to displace the fork to the latched position. The operation (connection) of the open lever with the opening operation is selectively prohibited by a disabling mechanism provided between the door handle and the open lever. The closing mechanism preferably includes: a driving source configured to generate a driving force; a pivoting body pivotably supported by the base member about a second axis that is parallel to the first axis. The pivoting body can be driven by the driving source to pivot when the fork is disposed in the half latched position; a close lever pivotably supported by the pivoting body about a third axis that is parallel to or coaxial with the second axis; a transmitting member provided in or on one of the pivoting body and the close lever, the transmitting member being displaceable between an engaging position, where the transmitting member engages with the other of the pivoting body and the close lever and regulates relative displacement of the close lever and the pivoting body, and a releasing position, where the transmitting member stops engaging with the other of the pivoting body and the close lever and allows the relative displacement; and a cancel lever pivotably supported by the base member about a fourth axis parallel to or coaxial with the first axis, the cancel lever pivoting in connection with the opening operation independently of the open lever and displacing the transmitting member from the engaging position to the releasing position. The close lever is preferably configured to come into contact with the fork when it is disposed in the half latched position through the pivoting of the pivoting body and to displace the fork to the latched position when the transmitting member is disposed in the engaging position and, on the other hand, to not come into contact with the fork irrespective of the pivoting of the pivoting body when the transmitting member is disposed in the releasing position.

In such a vehicle door lock apparatus, the cancel lever may be pivotably supported about the fourth axis that is parallel to or coaxial with the first axis, it may pivot in connection with the opening operation of the door handle independently of the open lever, and it may displace the transmitting member from the engaging position to the releasing position. Preferably, the cancel lever is a member (structural element) separate from the open lever. Consequently, in such a vehicle door lock apparatus, when the operation (connection) of the open lever is prohibited by the disabling mechanism, even when the opening operation for the door handle is performed while the closing mechanism operates to close the door and displaces the fork from the half latched position to the latched position, the cancel lever pivots in connection with the opening operation of the door handle and displaces the transmitting member from the engaging position to the releasing position. Therefore, since the transmitting member allows the relative displacement of the close lever and the pivoting body, the close lever stops coming into contact with the fork irrespective of the pivoting of the pivoting body. As a result, by using such a vehicle door lock apparatus, even if the operation (connection) of the open lever with the opening operation for the door handle is prohibited, it is possible to stop the operation for closing the door by the closing mechanism.

Therefore, by using such a vehicle door lock apparatus, it is possible to improve safety during the operation of the closing mechanism.

Since the first axis of the open lever, the second axis of the pivoting body, the third axis of the close lever, and the fourth axis of the cancel lever extend in the same direction, such a vehicle door lock apparatus may have a reduced size as compared to embodiments in which these axes cross one another.

In a preferred embodiment, the fourth axis is coaxial with the first axis. In this case, it is possible to realize a further reduction of the size of the vehicle door lock apparatus as compared to an embodiment in which the fourth axis is spaced (separated) from the first axis. By using such a vehicle door lock apparatus, since the open lever and the cancel lever can share a support shaft, it is possible to realize a reduction in manufacturing costs due to a reduction in the number of components (i.e. due to a reduced part count).

In addition or in the alternative, the third axis is preferably farther spaced (separated) from the transmitting member than is the second axis. In such a vehicle door lock apparatus, it is possible to increase a lever ratio of the close lever with respect to the transmitting member as compared to an embodiment in which the third axis is coaxial with the second axis. Therefore, it is possible to reduce the pressing force of the close lever on the transmitting member. As a result, by using such a vehicle door lock apparatus, it is possible to reduce the operation force of the cancel lever that is required to displace the transmitting member from the engaging position to the releasing position.

In addition or in the alternative, the open lever is preferably adjacent to the cancel lever, which displaces the transmitting member to the releasing position, from the opposite side of the transmitting member and is pivotable in the same direction as the cancel lever in connection with the opening operation. Even if the cancel lever cannot pivot in connection with the opening operation because of breakage of a member (structural element) that couples the door handle and the cancel lever, if the open lever pivots in connection with the opening operation, the open lever can come into contact with the cancel lever and cause the cancel lever to pivot to displace the transmitting member to the releasing position. As a result, by using such a vehicle door lock apparatus, it is possible to further improve safety during the operation of the closing mechanism.

DETAILED DESCRIPTION

An embodiment representative of the present teachings will be explained below with reference to the drawings.

Figure 1:
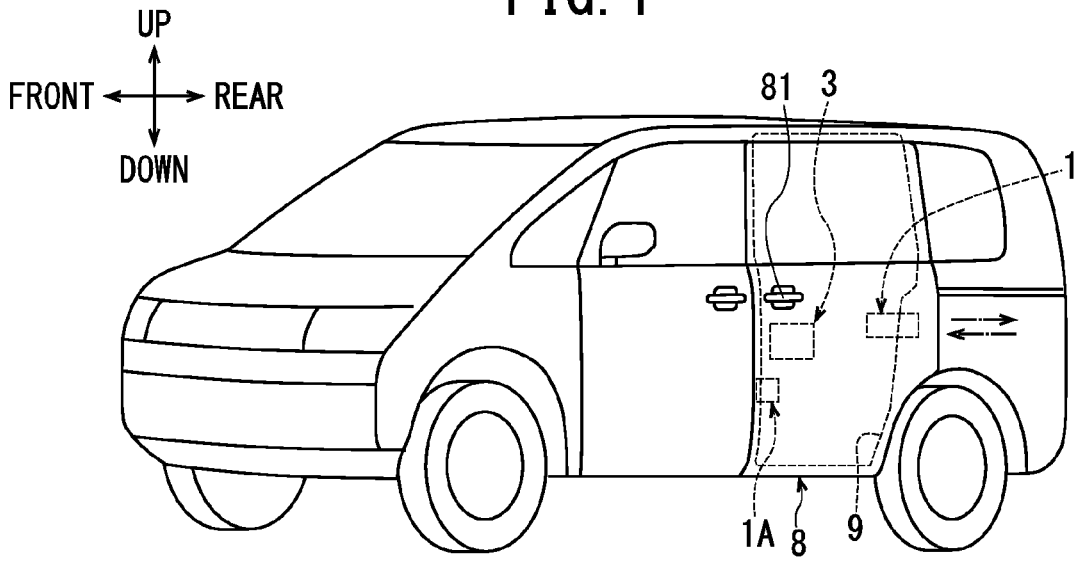
FIG. 1 is a perspective view of a vehicle in which a vehicle door lock apparatus is used in accordance with a representative embodiment of the present teachings.

As shown in FIG. 1, a vehicle door lock apparatus 1 according to the representative embodiment (hereinafter simply referred to as "door lock apparatus 1") may be used in an automobile. An opening 9 and a slide door 8 are provided on the left side surface of the automobile. A passenger gets on and off a rear seat in a vehicle interior via the opening 9. The slide door 8 closes the opening 9 in the position shown in FIG. 1. The slide door 8 slides rearward from the position shown in FIG. 1 to thereby open the opening 9. The slide door 8 is an example of a "door" according to the present teachings.

In this embodiment, the slide door 8 is preferably an electronic automatic slide door. When the passenger performs an opening operation or a closing operation to open or close the slide door 8, an electronic slide mechanism (not illustrated) operates, the slide door 8 slides, and the opening 9 is automatically opened or closed.

Figure 2:
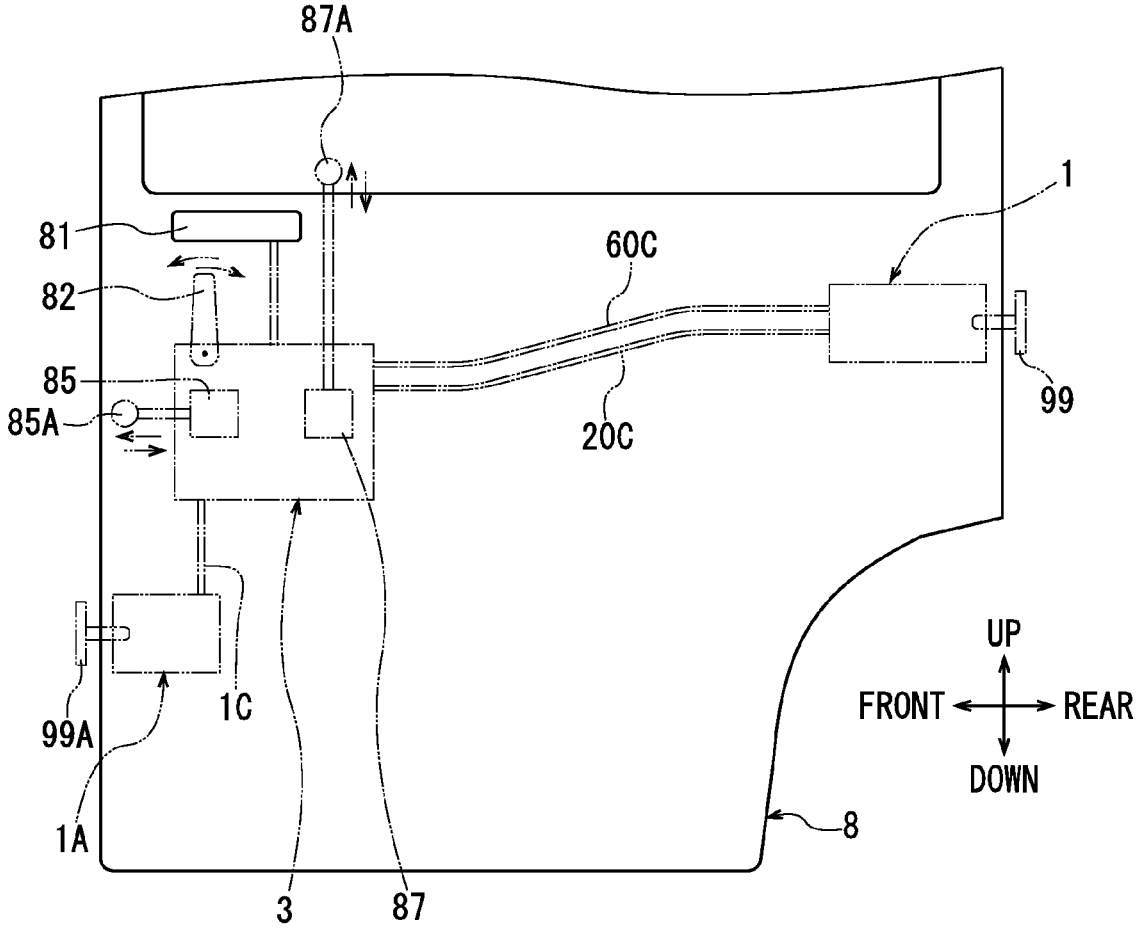
FIG. 2 is a partial schematic view showing a slide door of the vehicle in which the representative vehicle door lock apparatus is used.

The front-rear direction and the up-down direction shown in FIG. 2 as well as several of the subsequent Figures are displayed to correspond to FIG. 1. The in-out direction shown in FIG. 3 and subsequent figures is shown to define the outer surface side of the slide door 8 as a vehicle outer side and to define the inner surface side of the slide door 8 exposed in the vehicle interior as a vehicle inner side. In this embodiment, the door lock apparatus 1 provided in the left-side slide door 8 is illustrated. However, in the case of a right side door, the door lock apparatus 1 may be symmetrically identical. The door lock apparatus 1 could also be provided in a vehicle door that pivotably opens and closes a tail gate, etc.

As shown in FIG. 2, the door lock apparatus 1 is disposed on the rear end side in the slide door 8. A door lock apparatus 1A is disposed on the front end side in the slide door 8. When the slide door 8 is positioned as shown in FIG. 1, the door lock apparatus 1 engages with a striker 99 fixed to the rear edge of the opening 9 and the door lock apparatus 1A engages with a striker 99A fixed to the front edge of the opening 9 and act to maintain the slide door 8 in a closed state.

Figure 3:
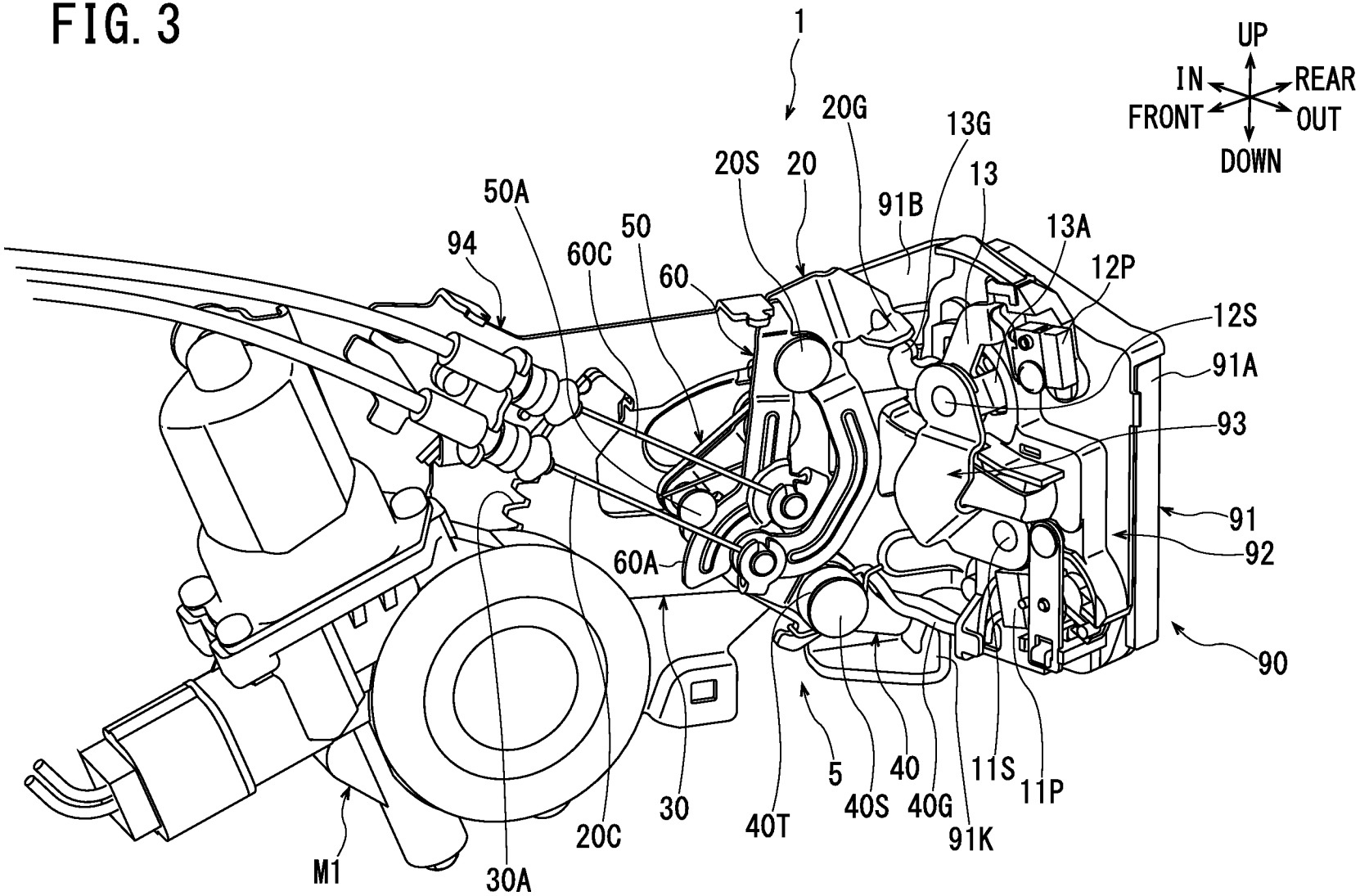
FIG. 3 is a perspective view of the representative vehicle door lock apparatus.

A remote controller unit 3 is disposed in front of the door lock apparatus 1 and above the door lock apparatus 1A in the slide door 8. As shown in FIGS. 2 and 3, the remote controller unit 3 is coupled to an open lever 20 of the door lock apparatus 1 by a cable 20C. The remote controller unit 3 is coupled to a cancel lever 60 of the door lock apparatus 1 by a cable 60C. As shown in FIG. 2, the remote controller unit 3 is coupled to the door lock apparatus 1A by a cable 1C.

An exterior door handle 81 is disposed on the front outer surface of the slide door 8. An interior door handle 82 is disposed in the vicinity of the exterior door handle 81 on the inner surface of the slide door 8. The exterior door handle 81 and the interior door handle 82 are respectively coupled to the remote controller unit 3 by coupling members such as rods or cables. The exterior door handle 81 and the interior door handle 82 are respectively examples of a "door handle" according to the present teachings.

When a passenger operates the exterior door handle 81 or the interior door handle 82 to open the slide door 8, the remote controller unit 3 acts on the door lock apparatus 1 and the door lock apparatus 1A, releases engagement with the striker 99 by the door lock apparatus 1, and releases engagement with the striker 99A by the door lock apparatus 1A. As a result, the slide door 8 changes to an openable state. When a control section (not illustrated) detects that the opening operation for the exterior door handle 81 or the interior door handle 82 is being performed, the engagement with the striker 99 by the door lock apparatus 1 is released, and the engagement with the striker 99A by the door lock apparatus 1A is released, and then the control section controls the electric slide mechanism, slides the slide door 8 rearward, and opens the opening 9.

A lock/unlock mechanism 87 and a child lock mechanism 85 are preferably incorporated in the remote controller unit 3. In this case, a door lock knob 87A and a child lock knob 85A may be disposed in the vicinity of the remote controller unit 3 on the inner surface of the slide door 8. The door lock knob 87A may be coupled to the lock/unlock mechanism 87 by a coupling member such as a rod or a cable or directly without using such a coupling member. The child lock knob 85A may be coupled to the child lock mechanism 85 by a coupling member such as a rod or a cable or directly without using such a coupling member. The lock/unlock mechanism 87 and the child lock mechanism 85 are respectively examples of a "disabling mechanism" according to the present teachings.

When the passenger displaces the door lock knob 87A from an unlocking position to a locking position, the lock/unlock mechanism 87 prohibits operation of the cable 20C and the cable 1C. As a result, the slide door 8 is switched from an unlocked state to a locked state. It is noted that the lock/unlock mechanism 87 may operate in the same manner when the passenger operates a central door lock key or a remote controller key to lock all doors of the vehicle. However, in this embodiment, explanation of the operation of the lock/unlock mechanism 87 is omitted.

When the passenger displaces the child lock knob 85A from a child lock releasing position to a child lock position, the child lock mechanism 85 prohibits operation of the cable 20C and the cable 1C only when the interior door handle 82 is operated. As a result, the slide door 8 is switched from a child lock release state to a child lock state.

In short, the lock/unlock mechanism 87 and the child lock mechanism 85 are provided between the exterior door handle 81 or the interior door handle 82 and the open lever 20. The lock/unlock mechanism 87 selectively prohibits the connection of the open lever 20 with the exterior door handle 81 or with the interior door handle 82 thereby switching the slide door 8 to the locked state. The child lock mechanism 85 selectively prohibits the connection of the open lever 20 with the interior door handle 82 thereby switching the slide door 8 to the child lock state.

Note that, in this embodiment, even when the operation of the cable 20C is prohibited by the lock/unlock mechanism 87 or the child lock mechanism 85, the operation of the cable 60C is not prohibited. The cancel lever 60 is still caused to pivot by the cable 60C when the exterior door handle 81 or the interior door handle 82 is operated.

The configuration of the door lock apparatus 1 will now be explained in further detail. As shown in FIGS. 3 to 6, the door lock apparatus 1 includes a base member 90, a fork 11, a pawl 12, the open lever 20, and a closing mechanism 5.

The base member 90 includes a base plate 91, an intermediate housing 92, a back plate 93, and a support plate 94.

Figure 4:
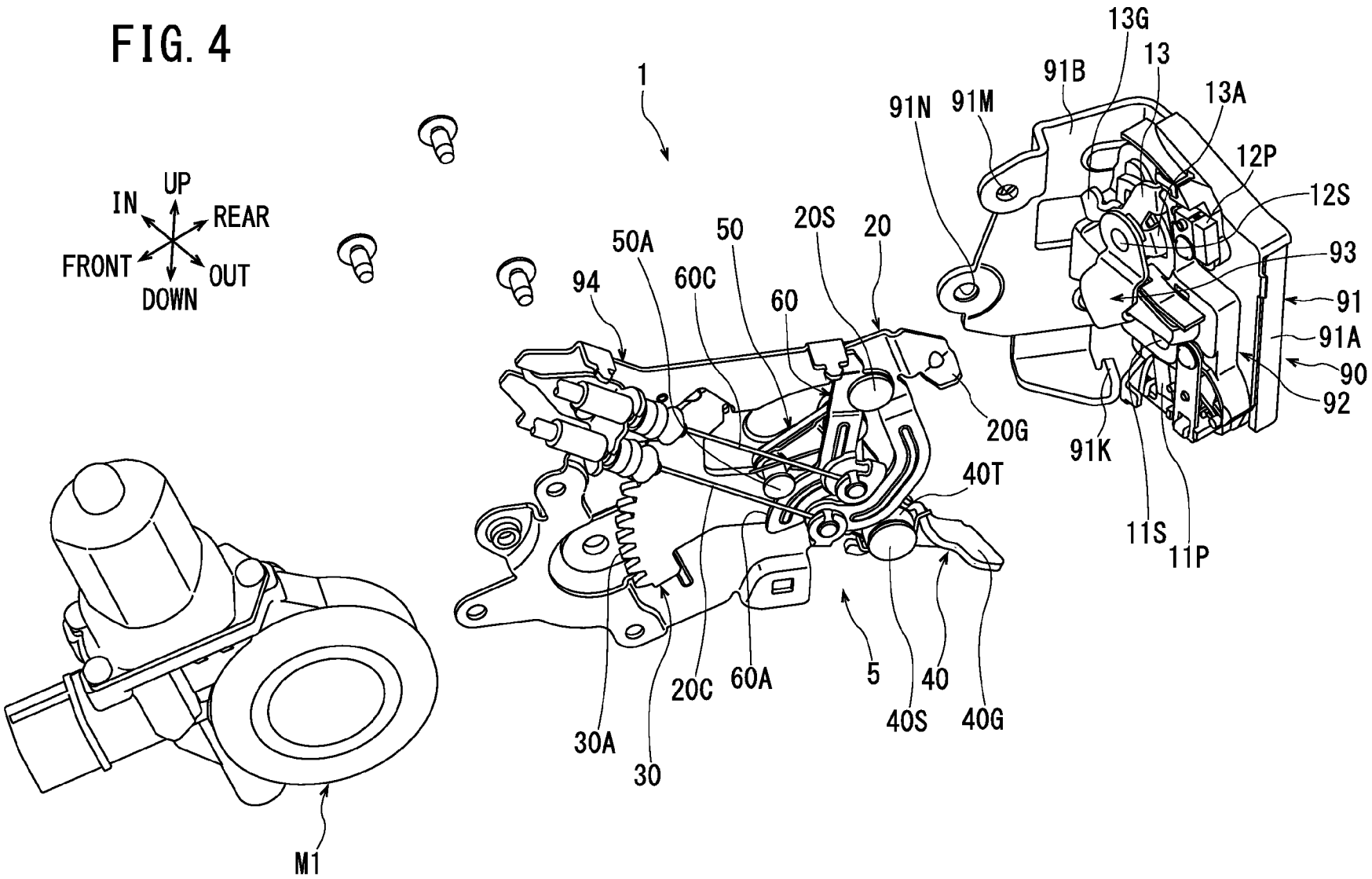
FIG. 4 is an exploded perspective view of the representative vehicle door lock apparatus.
Figure 6:
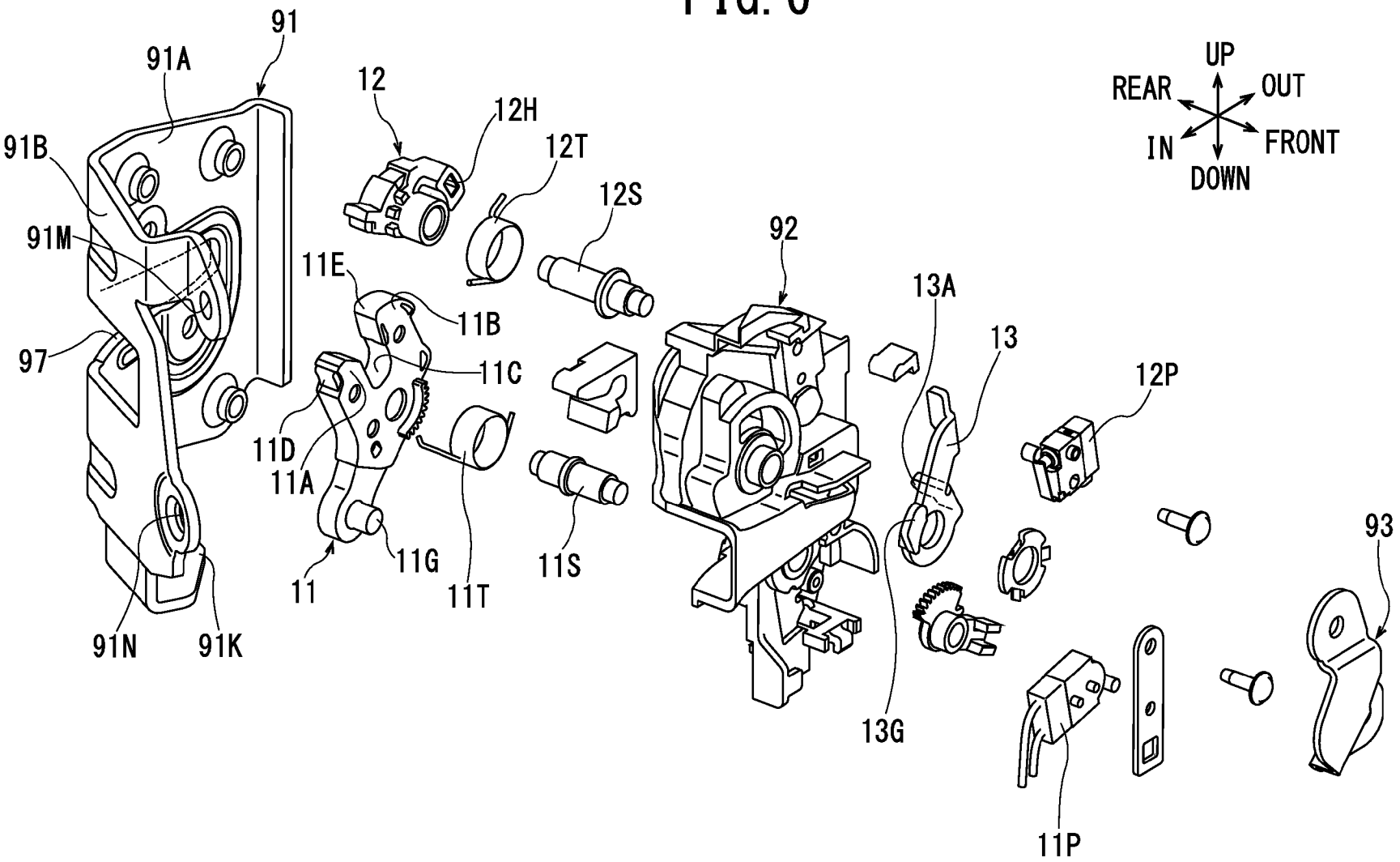
FIG. 6 is another exploded perspective view the representative vehicle door lock apparatus and mainly shows the base member, a fork, and a pawl.

As shown in FIGS. 3, 4, and 6, the base plate 91 is made of a bent steel plate. The base plate 91 includes a fixable portion 91A and a coupling portion 91B. The fixable portion 91A is affixed to the rear end face of the slide door 8 by screws, bolts, etc. The fixable portion 91A extends in the up-down direction and in the vehicle in-out direction. The coupling portion 91B is bent from the end edge on the vehicle inner side of the fixed portion 91A and extends forward. An entry opening (FIG. 6) is formed in the fixable portion 91A. The entry opening 97 is deeply cut out in a groove shape from the vehicle inner side toward the vehicle outer side. The entry opening 97 is exposed from the rear end face of the slide door 8. As shown in FIGS. 4 and 6, connecting holes 91M and 91N extend or pass through the coupling portion 91B.

As shown in FIGS. 3, 4, and 6, the intermediate housing 92 is preferably a resin molded product in which a plurality of recesses, holes, etc. are formed. The intermediate housing 92 is adjacent to and frontward of the fixable portion 91A of the base plate 91; the fork 11, a fork support shaft 11S, the pawl 12, a pawl support shaft 12S, etc. are housed in the intermediate housing 92.

The back plate 93 is adjacent to and frontward of the intermediate housing 92. The front and rear ends of the fork support shaft 11S and the pawl support shaft 12S are caulked by (secured to, e.g., by bending or upsetting the ends thereof) the fixable portion 91A of the base plate 91 and the back plate 93, whereby the base plate 91, the intermediate housing 92, and the back plate 93 are integrally assembled.

Figure 5:
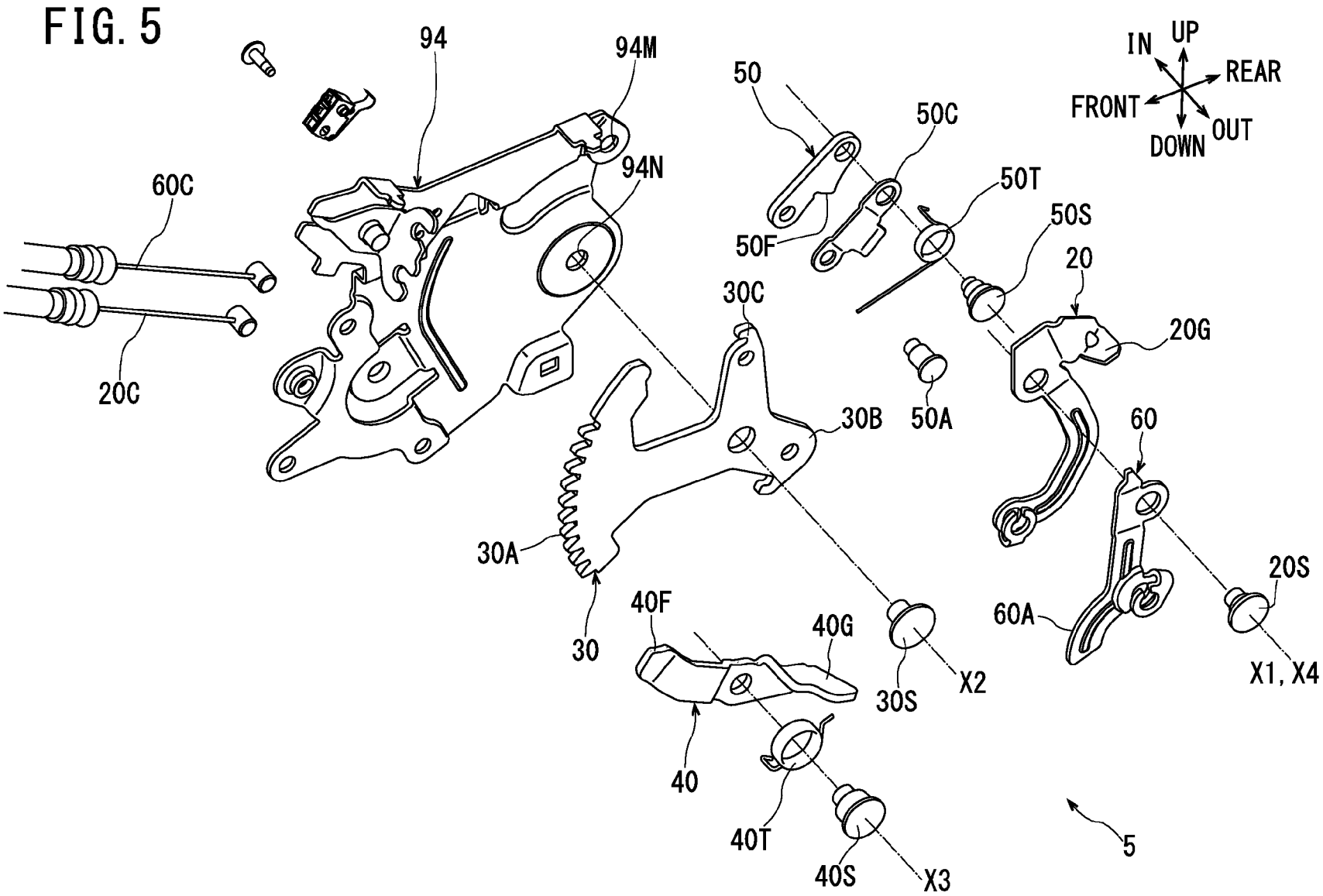
FIG. 5 is another exploded perspective view the representative vehicle door lock apparatus and mainly shows a base member, an open lever, a pivoting body, a close lever, a transmitting member, and a cancel lever.

As shown in FIGS. 3 to 5, the support plate 94 is preferably made of a bent steel plate and extends in the front-rear direction and the up-down direction. As shown in FIG. 5, connecting holes 94M and 94N extend or pass through the support plate 94. An open lever support shaft 20S is inserted through the connecting hole 91M of the coupling portion 91B and the connecting hole 94M of the support plate 94 and is caulked (e.g., secured or affixed by bending or upsetting the end). A pivoting body support shaft 30S is inserted through the connecting hole 91N of the coupling portion 91B and the connecting hole 94N of the support plate 94 and is caulked (e.g., secured or affixed by bending or upsetting the end). In this way, the coupling portion 91B and the support plate 94 are connected.

As shown in FIGS. 6 and 7, the fork support shaft 11S is located below the entry opening 97. The pawl support shaft 12S is located above the entry opening 97. The fork 11 is pivotably supported by the fork support shaft 11S. The pawl 12 is pivotably supported by the pawl support shaft 12S. As shown in FIG. 6, a first torsion coil spring 11T is attached to the fork support shaft 11S. A second torsion coil spring 12T is attached to the pawl support shaft 12S.

Figure 7A:
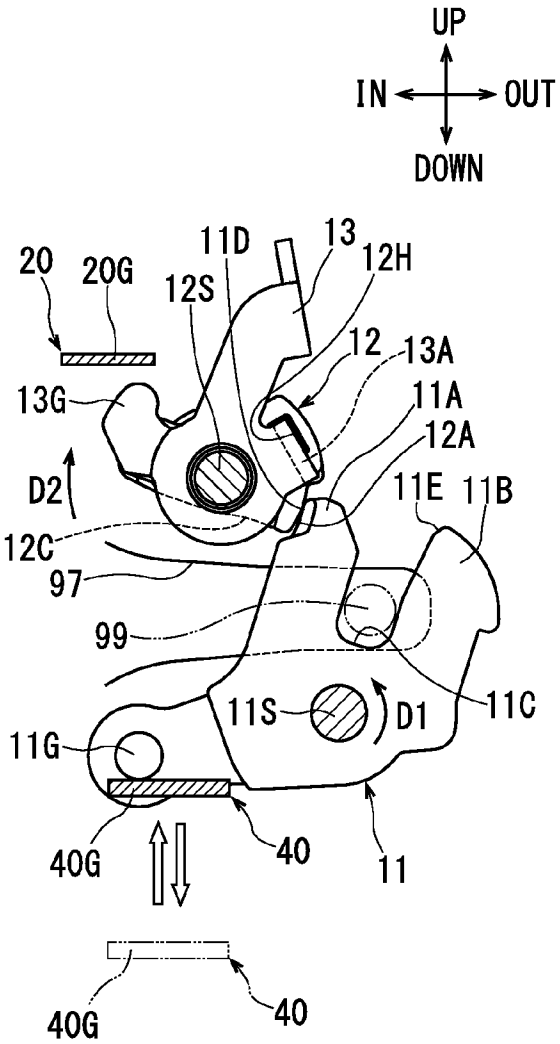
FIGS. 7A to 7C are schematic diagrams of the representative vehicle door lock apparatus that illustrate operations of the fork, the pawl, the open lever, and the close lever.

As shown in FIG. 7A, the fork 11 is biased by the first torsion coil spring 11T to pivot in a direction D1 around the fork support shaft 11S. A part of the fork 11 located on the entry opening 97 side of the fork support shaft 11S is divided into an inner projection 11A and an outer projection 11B. A cutout portion 11C is formed between the inner projection 11A and the outer projection 11B. When the striker 99 advances into the entry opening 97, it enters into and fits in the cutout portion 11C. When the fork 11 is located in the position shown in FIG. 7A, the fork 11 holds the striker 99 in the bottom of the entry opening 97. A latch surface 11D capable of coming into contact with a stopper surface 12A (explained below) is formed on the distal end side of the inner projection 11A facing the pawl 12. When the fork 11 is located in the position shown in FIG. 7B, the fork 11 holds the striker 99 halfway in the entry opening 97. A half latch surface 11E capable of coming into contact with the stopper surface 12A is formed on the distal end side of the outer projection 11B facing the pawl 12.

As shown in FIGS. 6 and 7, a contactable portion 11G is provided on the distal end side of a part of the fork 11 that extends from the fork support shaft 11S to the vehicle inner side and downward. The contactable portion 11G is a columnar shaft body that projects forward.

As shown in FIG. 7A, the pawl 12 is biased to pivot in a direction D2 around the pawl support shaft 12S by the second torsion coil spring 12T. The stopper surface 12A is formed on a part of the pawl 12 located on the bottom side of the pawl 12 near the entry opening 97. The stopper surface 12A is formed to face the latch surface 11D when the fork 11 is in the position shown in FIG. 7A and to face the half latch surface 11E when the fork 11 is in the position shown in FIG. 7B. An arc forming the stopper surface 12A is broken off (terminates at a location) on the fork 11 side. A sliding surface 12C extending to the pawl support shaft 12S side is formed from the location where the arc is broken off.

The pawl 12 includes an input section 13 shown, for example, in FIGS. 3, 6, and 7. The input section 13 is pivotably supported by the pawl support shaft 12S between the intermediate housing 92 and the back plate 93. The input section 13 is made of a bent steel plate and includes a coupling portion 13A and a contactable portion 13G.

As shown in FIGS. 6 and 7, the coupling portion 13A is bent at a location spaced from the pawl support shaft 12S, extends rearward, and fits in a coupling hole 12H of the pawl 12. The contactable portion 13G is located on the opposite side of the stopper surface 12A of the pawl 12 across the pawl support shaft 12S and projects to the vehicle inner side and upward. The pawl 12 and the input section 13 integrally pivot around the pawl support shaft 12S due to the mating of the coupling portion 13A and the coupling hole 12H.

As shown in FIG. 7A, when the fork 11 holds the striker 99 in the bottom of the entry opening 97, the stopper surface 12A comes into contact with the latch surface 11D of the inner projection 11A, and thus the pawl 12 fixes the fork 11 against pivoting in the D1 direction. The position of the fork 11 shown in FIG. 7A is a latched position that locks the striker 99 at the depth (bottom) side of the entry opening 97.

Figure 7B:
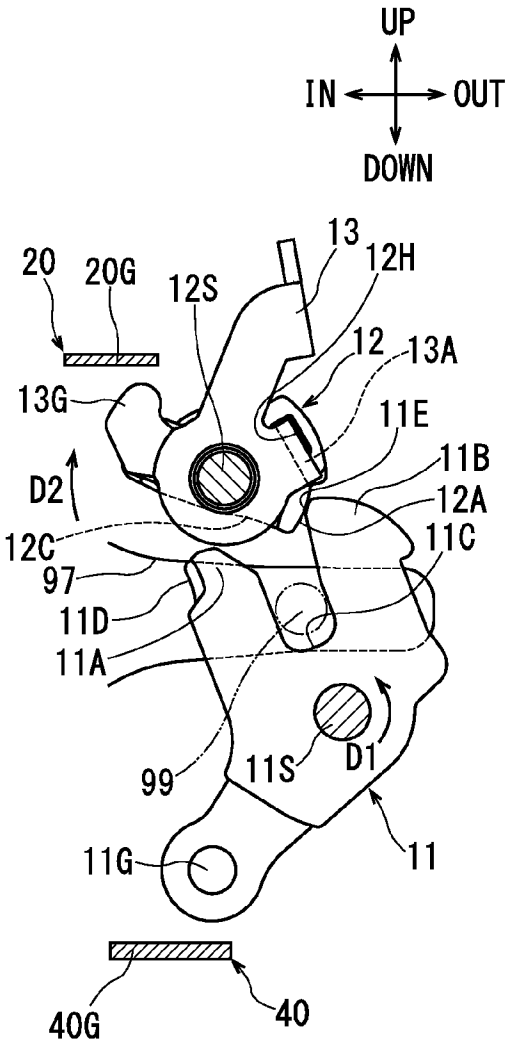

As shown in FIG. 7B, when the fork 11 holds the striker 99 halfway in the entry opening 97, the stopper surface 12A comes into contact with the half latch surface 11E of the outer projection 11B and thus the pawl 12 fixes the fork 11 against pivoting in the D1 direction. The position of the fork 11 shown in FIG. 7B is a half latched position that locks the striker 99 halfway in the entry opening 97.

Figure 8:
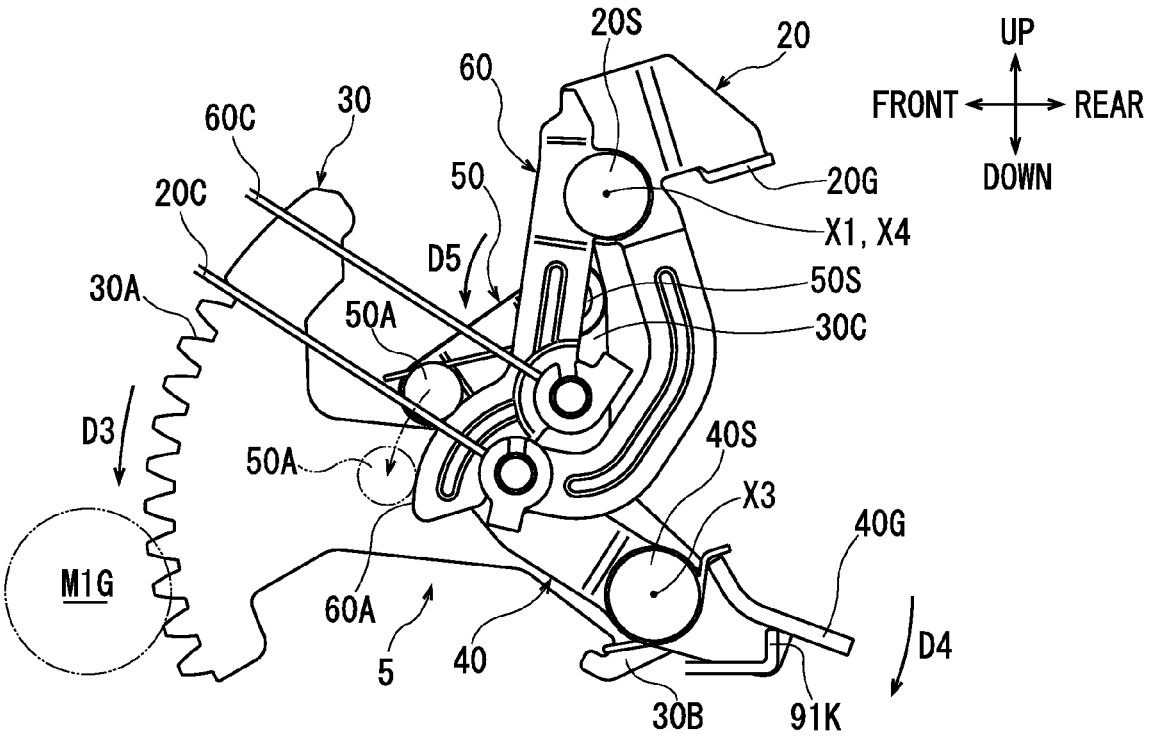
FIG. 8 is a side view the representative vehicle door lock apparatus and mainly shows the pivoting body, the unpivoted open lever, the unpivoted cancel lever, and the transmitting member disposed in an engaging position.

As shown in FIGS. 3 to 5 and FIGS. 8 to 10, the open lever 20 is preferably an elongated metal member generally extending in the up-down direction. The upper end side of the open lever 20 is pivotably supported by the open lever support shaft 20S. As shown in FIGS. 5 and 8, the open lever support shaft 20S defines a first axis X1 extending in the vehicle in-out direction. That is, the open lever 20 is pivotably supported about the first axis X1 by the base member 90.

The open lever 20 includes a contactable portion 20G spaced rearwardly from the open lever support shaft 20S. As shown in FIGS. 3 and 7, the contactable portion 20G opposes the contactable portion 13G of the input section 13 from above.

As shown in FIGS. 3, 4, and 8, the cable 20C is coupled to the lower end side of the open lever 20. When the remote controller unit 3 selectively causes the cable 20C to operate in response to an opening operation of the exterior door handle 81 or the interior door handle 82, the lower end side of the open lever 20 is pulled forward. Consequently, the open lever 20 pivots from the position shown in FIG. 8 to the position shown in FIG. 9. As a result, as shown in FIG. 7C, the contactable portion 20G comes into contact with the contactable portion 13G of the input section 13 and pushes down the contactable portion 13G.

When the contactable portion 13G is pushed down, the pawl 12 pivots in the opposite direction of the D2 direction around the pawl support shaft 12S while resisting (overcoming) the biasing force of the second torsion coil spring 12T. At this point, since the stopper surface 12A separates from the latch surface 11D or the half latch surface 11E, the pawl 12 allows pivoting of the fork 11. The fork 11 pivots in the D1 direction around the fork support shaft 11S because of the biasing force of the first torsion coil spring 11T. The striker 99 is allowed to be displaced in a direction in which the striker 99 separates from the entry opening 97. The position of the fork 11 shown in FIG. 7C is an unlatched position in which the striker 99 is not locked in the entry opening 97.

As shown in FIGS. 3, 6, etc., a fork position sensor 11P and a pawl position sensor 12P are assembled onto the intermediate housing 92. The fork position sensor 11P detects whether the fork 11 is located in the latched position, the half latched position, or the unlatched position and informs the not-shown control section of the position. The pawl position sensor 12P detects whether the fork 11 pivots and informs the not-shown control section to that effect.

Figure 7C:
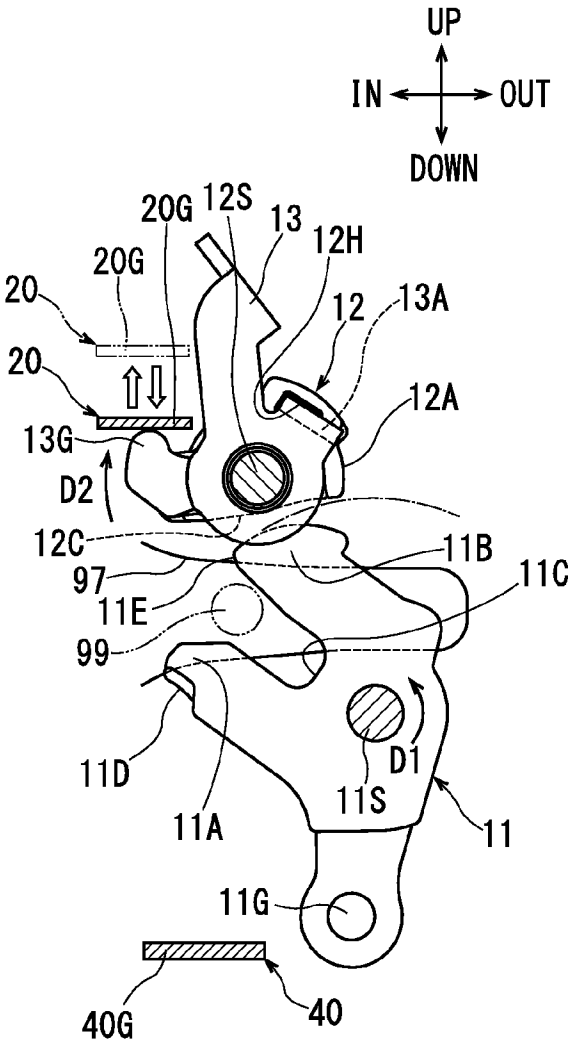

On the other hand, when the striker 99 advances into the entry opening 97, since the striker 99 pushes the outer projection 11B to the position shown in FIG. 7C, the fork 11 pivots in the opposite direction of the D1 direction following the outer projection 11B and is displaced to the half latched position shown in FIG. 7B. At this point, the distal end of the outer projection 11B comes into sliding contact with the sliding surface 12C. When the distal end of the outer projection 11B separates from the sliding surface 12C, the pawl 12 pivots in the D2 direction and is displaced to the posture (position) shown in FIG. 7B. Therefore, the stopper surface 12A comes into contact with the half latch surface 11E and fixes f the fork 11 in the half latched position.

When the fork position sensor 11P detects that the fork 11 has been displaced to the half latched position, the control section causes the closing mechanism 5 to operate. Then, a close lever 40 operates as explained below. A contactable portion 40G of the close lever 40 comes into contact with the contactable portion 11G of the fork 11 that is located in the half latched position shown in FIG. 7B. The contactable portion 40G pushes up the contactable portion 11G to thereby displace the fork 11 to the latched position shown in FIG. 7A. At this point, the distal end of the inner projection 11A comes into sliding contact with the sliding surface 12C. When the distal end of the inner projection 11A separates from the sliding surface 12C, the pawl 12 pivots in the D2 direction and returns to the original posture (position) shown in FIG. 7A. Therefore, the stopper surface 12A comes into contact with the latch surface 11D and fixes the fork 11 in the latched position.

As shown in FIGS. 3 to 5, the closing mechanism 5 includes a driving source (actuator or motor) M1, a pivoting body 30, the close lever 40, a transmitting member 50, and the cancel lever 60.

As shown in FIGS. 3 and 4, the driving source M1 is screwed to the front end side of the support plate 94. The driving source M1 is a motor unit that includes a not-shown electric motor and a not-shown transmission gear group (gear set) housed on the inside and an output gear M1G exposed to the outside as shown in FIG. 8, etc. The electric motor is controlled by the not-shown control section to rotate, whereby the driving source M1 generates a driving force and rotates the output gear M1G.

Figure 11:
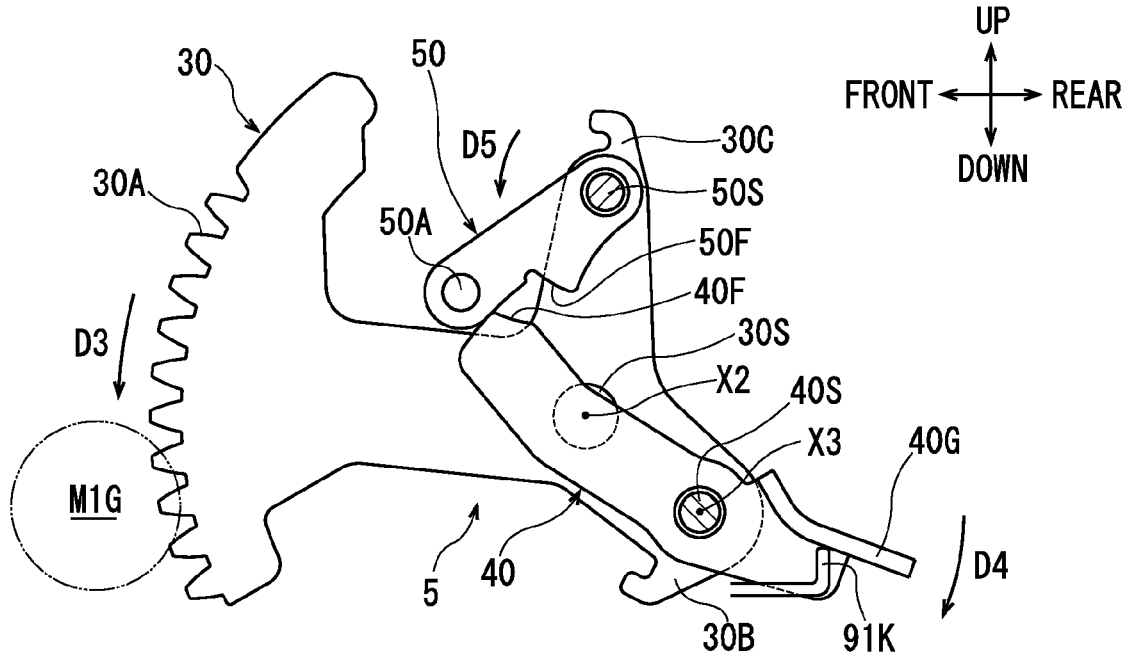
FIG. 11 is a side view of the representative vehicle door lock apparatus and mainly shows the unpivoted pivoting body, the transmitting member disposed in the engaging position, and the close lever.

The pivoting body 30 is a sector gear made of a steel plate. As shown in FIGS. 5, 11, and the like, the pivoting body 30 is pivotably supported by the pivoting body support shaft 30S. The pivoting body support shaft 30S defines a second axis X2 extending in a vehicle in-out direction. That is, the pivoting body 30 is pivotably supported about the second axis X2 parallel to the first axis X1 with respect to the support plate 94 of the base member 90.

As shown in FIGS. 5, 8, 11, etc., a teeth portion 30A, a close lever support portion 30B, and a transmitting member support portion 30C are formed in the pivoting body 30. In the teeth portion 30A, a plurality of teeth are formed in an arc portion extending in the up-down direction at a location spaced forwardly of the pivoting body support shaft 30S. The close lever support portion 30B projects rearward and downward from the pivoting body support shaft 30S. The transmitting member support portion 30C projects upward from the pivoting body support shaft 30S.

As shown in FIGS. 8, 11, etc., the teeth portion 30A meshes with the output gear M1G of the driving source M1. When the fork position sensor 11P detects that the fork 11 is present in the half latched position, the not-shown control section controls (actuates) the driving source M1 to normally rotate the output gear M1G (e.g. rotate clockwise). Therefore, a driving force is transmitted from the driving source M1 to the pivoting body 30 via the teeth portion 30A. The pivoting body 30 pivots in a direction D3. As a result, the pivoting body 30 pivots from the position shown in FIGS. 8 to 11 to the position shown in FIG. 13 in the process passing through the position shown in FIG. 12. Thereafter, the not-shown control section controls the driving source M1 to rotate the output gear M1G in a reverse or opposite direction (e.g. rotate counterclockwise). Therefore, the pivoting body 30 pivots in the opposite direction of (counter to) the D3 direction. As a result, the pivoting body 30 returns from the position shown in FIG. 13 to the position shown in FIGS. 8 to 11 by passing through the position shown in FIG. 12.

As shown in FIG. 5, a close lever support shaft 40S is caulked (secured) on the distal end side of the close lever support portion 30B. The close lever support shaft 40S defines a third axis X3 extending in the vehicle in-out direction.

As shown in FIGS. 3 to 5 and FIGS. 8 to 14, the close lever 40 is an elongated metal member that inclines downwardly from the front to the rear. The close lever 40 is pivotably supported by the close lever support shaft 40S. That is, the close lever 40 is pivotably supported around the third axis X3 parallel to the second axis X2 by the pivoting body 30.

As shown in FIG. 5, a third torsion coil spring 40T is attached to the close lever support shaft 40S. As shown in FIGS. 8 and 11, the close lever 40 is biased by the third torsion coil spring 40T to pivot in a direction D4 about the close lever support shaft 40S.

As shown in, e.g., FIGS. 3 to 5, the close lever 40 includes the contactable portion 40G spaced rearwardly from the close lever support shaft 40S. On the other hand, the base plate 91 includes a regulating portion 91K formed at the lower end edge of the coupling portion 91B. The regulating portion 91K is bent upward after being bent from the lower end edge of the coupling portion 91B toward the vehicle outer side.

As shown in FIGS. 8 and 11, the contactable portion 40G comes into contact with the regulating portion 91K from above, whereby the posture (position) of the close lever 40, biased by the third torsion coil spring 40T, is set. As shown in FIG. 7, the contactable portion 40G opposes the contactable portion 11G of the fork 11 from below.

As shown in FIGS. 5 and 11, the close lever 40 projects from the close lever support shaft 40S forward and upward. The distal end of the close lever 40 is formed as an engaging portion 40F.

As shown in FIG. 5, a transmitting member support shaft 50S is caulked (secured) on the distal end side of the transmitting member support portion 30C. The transmitting member support shaft 50S extends in the vehicle in-out direction parallel to the first axis X1.

As shown in FIGS. 3 to 5 and FIGS. 8 to 14, the transmitting member 50 is provided in the pivoting body 30. The transmitting member 50 is a short metal member that inclines downwardly from the rear to the front. As shown in FIG. 5, a sub-plate 50C is additionally provided in the transmitting member 50. As shown in FIGS. 5, 11, etc., the rear end side of the transmitting member 50 is pivotably supported by the transmitting member support shaft 50S. A slide contact pin 50A is caulked (secured) on the front end side of the transmitting member 50. The slide contact pin 50A is a columnar shaft body projecting in the vehicle outer side direction.

As shown in FIGS. 5, 11, etc., an engaging surface 50F is formed on the transmitting member 50. The engaging surface 50F is an arc surface located between the transmitting member support shaft 50S and the slide contact pin 50A and extends rearward, the arc centering on the transmitting member support shaft 50S.

As shown in FIG. 5, a fourth torsion coil spring 50T is attached to the transmitting member support shaft 50S. As shown in FIGS. 8 and 11, the transmitting member 50 is biased by the fourth torsion coil spring 50T to pivot in a direction D5 about the transmitting member support shaft 50S.

As shown in, e.g., FIG. 11, the third axis X3 is spaced further away from the transmitting member 50 than the second axis X2 is spaced from the transmitting member 50.

As shown in FIGS. 3 to 5 and FIGS. 8 to 10, the cancel lever 60 is an elongated metal member extending in the up-down direction. The upper end side of the cancel lever 60 is pivotably supported by the open lever support shaft 20S. That is, the cancel lever 60 is pivotably supported about a fourth axis X4 coaxial with the first axis X1 with respect to the support plate 94 of the base member 90. The open lever 20 and the cancel lever 60 share the open lever support shaft 20S.

As shown in FIGS. 3, 4, and 8, the cable 60C is coupled to the intermediate portion of the cancel lever 60. A slide contact surface 60A is formed on the cancel lever 60. The slide contact surface 60A is an end face on the upper side that extends from the intermediate portion to the distal end of the cancel lever 60 in an arc shape. The transmitting member 50 is biased by the fourth torsion coil spring 50T so that the slide contact pin 50A is pressed against the slide contact surface 60A.

When the exterior door handle 81 is operated to open the door or when the interior door handle 82 is operated to open the door, the remote controller unit 3 causes the cable 60C to operate irrespective of the positions of the door lock knob 87A and the child lock knob 85A. Therefore, the lower end side of the cancel lever 60 is pulled forward. Consequently, the cancel lever 60 pivots from a position shown in FIG. 8 to a position shown in FIGS. 9 and 10.

Figure 9:
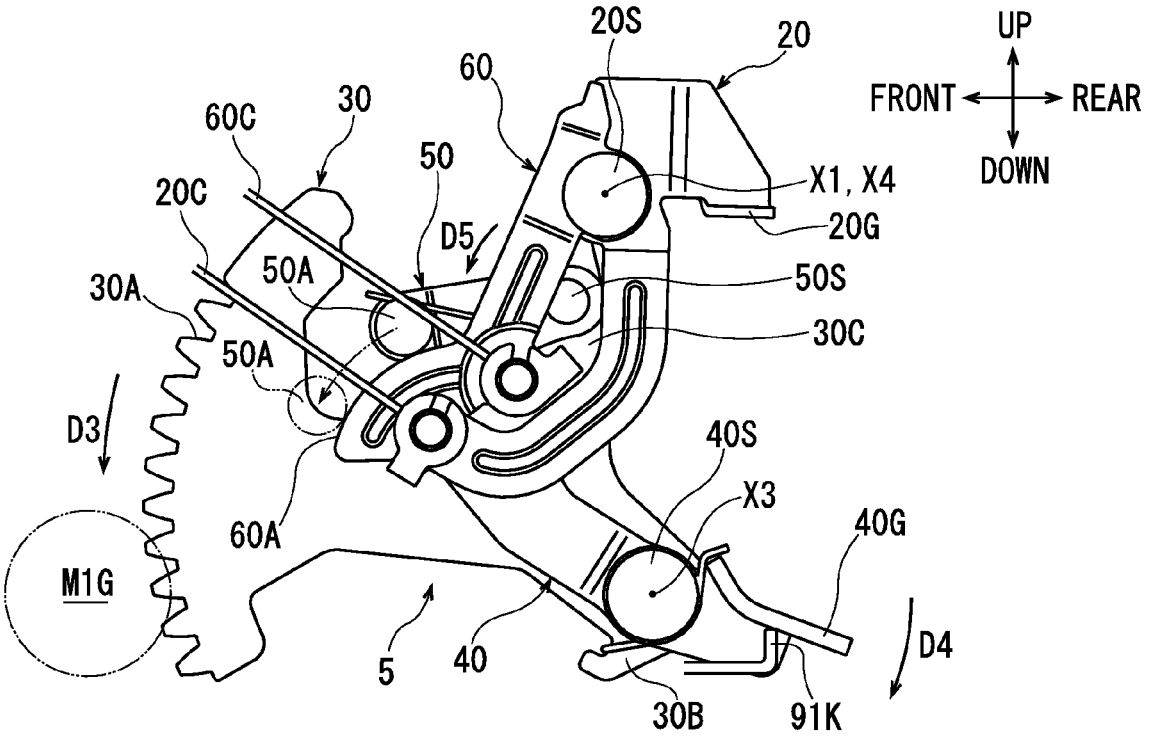
FIG. 9 is a side view the representative vehicle door lock apparatus and mainly shows the pivoting body, the pivoted open lever, the pivoted cancel lever, and the transmitting member displaced to a releasing position.

In FIG. 9, the remote controller unit 3 causes the open lever 20 to pivot in connection with the opening operation for the exterior door handle 81 and the interior door handle 82 due to the fact that the door lock knob 87A is in the unlocking position or the child lock knob 85A is in the child lock releasing position. In this case, the open lever 20 is adjacent to the pivoted cancel lever 60 from the opposite side of the transmitting member 50 and pivots in the same direction as the cancel lever 60 in connection with the opening operation. The intermediate portion of the pivoted cancel lever 60, to which the cable 60C is coupled, and the pivoted open lever 20 are adjacent and separated from each other by a small space (gap).

Figure 10:
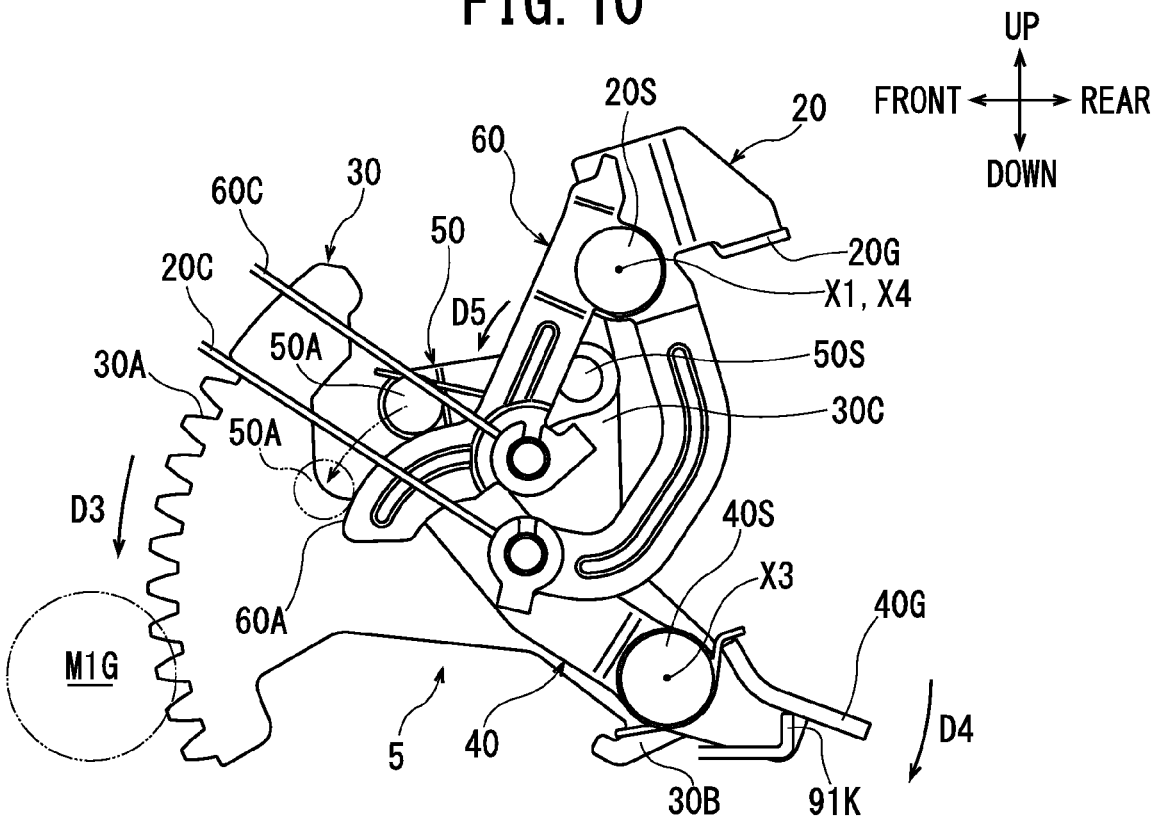
FIG. 10 is a side view the representative vehicle door lock apparatus and mainly shows the pivoting body, the unpivoted open lever, the pivoted cancel lever, and the transmitting member displaced to the releasing position.

On the other hand, in FIG. 10, the remote controller unit 3 selectively prohibits the connection of the open lever 20 with the opening operation due to the fact that the door lock knob 87A is in the locking position or the child lock knob 85A is in the child lock releasing position. That is, the cancel lever 60 pivots in connection with the opening operation independently from the open lever 20.

Figure 12:
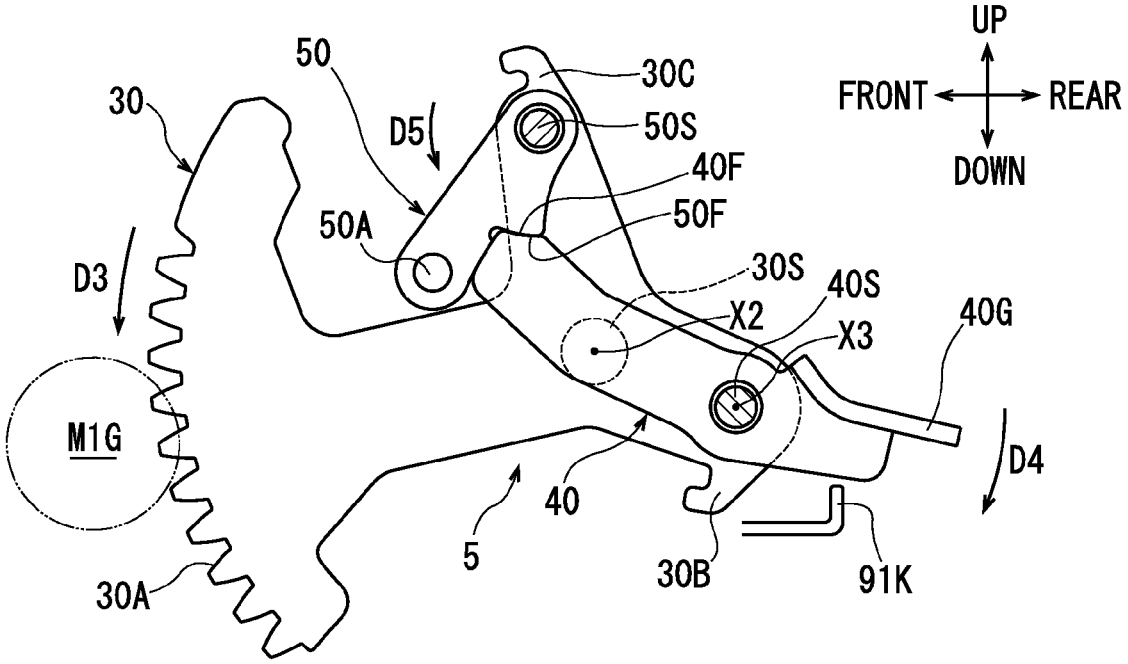
FIG. 12 is a side view of the representative vehicle door lock apparatus and mainly shows the pivoting body in the midst of pivoting, the transmitting member disposed in the engaging position, and the close lever in the midst of engaging with the transmitting member and pivoting.
Figure 13:
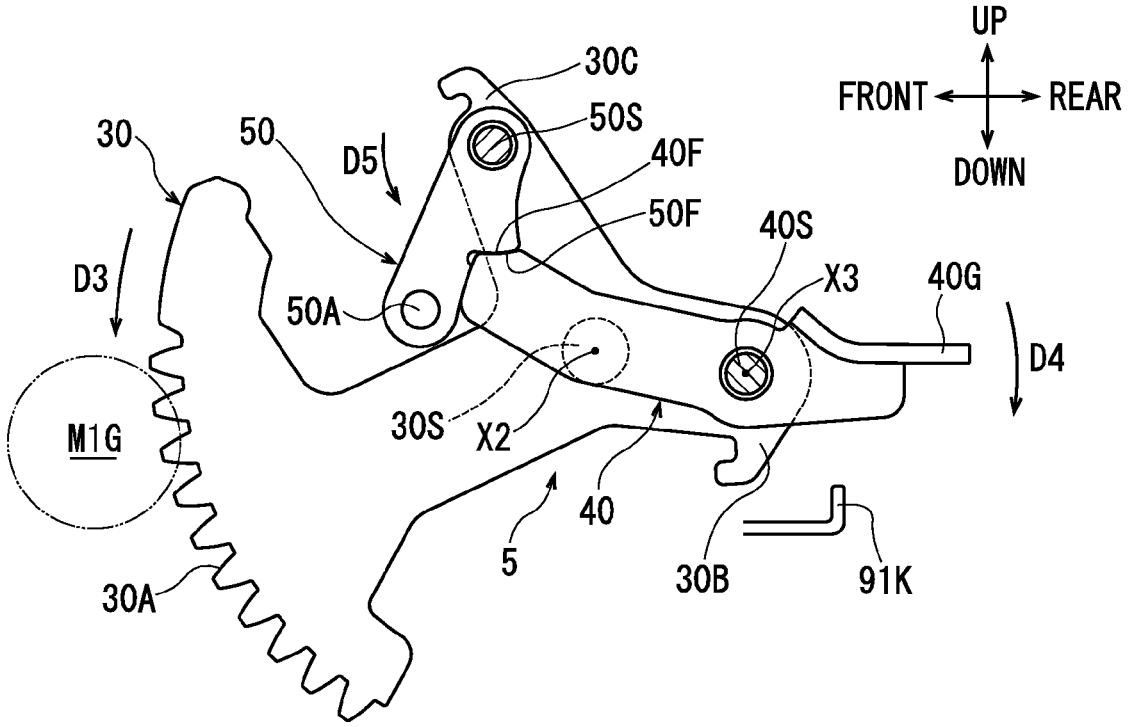
FIG. 13 is a side view of the representative vehicle door lock apparatus and mainly shows the pivoted pivoting body, the transmitting member disposed in the engaging position, and the close lever engaged with the transmitting member and pivoted.

As shown in FIG. 8, when the cancel lever 60 is not pivoted, pivoting the pivoting body 30 displaces the slide contact pin 50A slidingly along the slide contact surface 60A. As shown in FIGS. 11 to 13, the transmitting member 50 is close to the engaging portion 40F of the close lever 40. The position of the transmitting member 50 shown in FIGS. 8 and 11 to 13 is an engaging position. As shown in FIG. 12, when the transmitting member 50 is in the engaging position, the transmitting member 50 is displaced by the pivoting of the pivoting body 30 in the direction D3. The engaging surface 50F engages with the engaging portion 40F of the close lever 40. Consequently, since the transmitting member 50 regulates (controls) relative displacement of the close lever 40 and the pivoting body 30, as shown in FIG. 13, the close lever 40 pivots integrally with the pivoting body 30. The contactable portion 40G of the close lever 40 comes into contact with the contactable portion 11G of the fork 11 disposed in the half latched position shown in FIG. 7A. As shown in FIG. 7A, the close lever 40 pushes up the contactable portion 11G. As a result, the fork 11 is displaced to the latched position.

Figure 14:
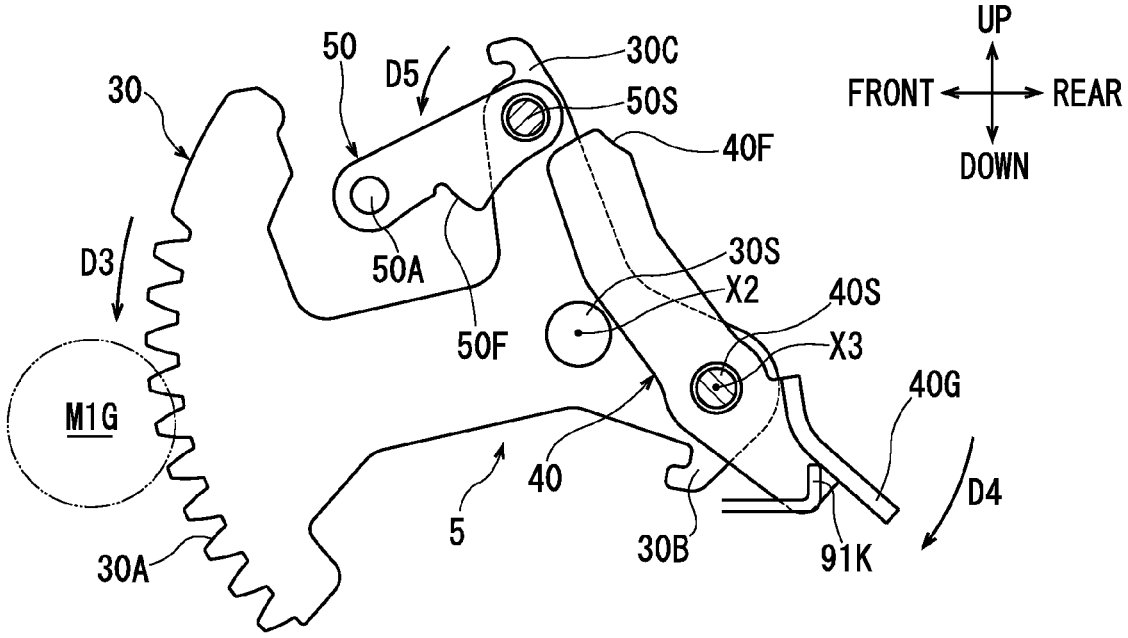
FIG. 14 is a side view of the vehicle door lock apparatus and mainly shows the pivoting body in the midst of pivoting, the transmitting member displaced to the releasing position, and the close lever stopped engaging with the transmitting member.

On the other hand, as shown in FIGS. 9 and 10, when the cancel lever 60 pivots, the slide contact pin 50A is slidingly displaced along the slide contact surface 60A by the pivoting of the pivoting body 30 so that the slide contact pin 50A is pushed up by the slide contact surface 60A and pivots in the opposite direction of the direction D5. In this case, the transmitting member 50 is separated (spaced) from the engaging portion 40F of the close lever 40. The position of the transmitting member 50 shown in FIGS. 9, 10, and 14 is the releasing position. As shown in FIG. 14, when the transmitting member 50 is located in the releasing position, the transmitting member 50 is displaced according to the pivoting of the pivoting body 30 in the direction D3. However, as shown in FIG. 14, the engaging surface 50F stops coming into contact with the engaging portion 40F of the close lever 40. Consequently, the transmitting member 50 allows relative displacement of the close lever 40 and the pivoting body 30. Therefore, the contactable portion 40G of the close lever 40 maintains a posture (position) in contact with the regulating portion 91K and does not come close to the contacted portion 11G.

A representative method for operating the representative door lock apparatus 1 will now be described. When the passenger performs (initiates) the closing operation of the slide door 8, the not-shown electronic slide mechanism operates and slides the slide door 8 forward to close the opening 9. When the striker 99 advances into the entry opening 97 and the fork 11 is pushed by the striker 99 and is displaced from the unlatched position to the half latched position while the slide door 8 is closed, the not-shown control section detects the displacement by using the fork position sensor 11P and causes the closing mechanism 5 to operate. Then, the pivoting body 30 is driven by the driving source M1 and pivots in the direction D3. At this point, if the opening operation for the exterior door handle 81 or the interior door handle 82 is not performed, as shown in FIG. 8, the cancel lever 60 does not pivot and the transmitting member is present (disposed) in the engaging position. Therefore, the engaging surface 50F engages with the engaging portion 40F and the transmitting member 50 regulates (controls) relative displacement of the close lever 40 and the pivoting body 30. Consequently, as shown in FIGS. 7A, 12, and 13, the close lever 40 comes into contact with the fork 11 present (disposed) in the half latched position, is moved by the pivoting of the pivoting body 30, and displaces the fork 11 to the latched position. In this way, it is possible to automatically close the slide door 8 by using the door lock apparatus 1.

In the door lock apparatus 1 as shown in FIGS. 5 and 8 to 10, the cancel lever 60 is pivotably supported about the fourth axis X4 coaxial with the first axis X1. The cancel lever pivots in connection with the opening operation of the exterior door handle 81 or the interior door handle 82 independently from the open lever 20 and displaces the transmitting member 50 from the engaging position to the releasing position. That is, the cancel lever 60 is a member (structural element) that is separate from the open lever 20. Consequently, in the door lock apparatus 1 as shown in FIG. 10, when the connection of the open lever 20 is prohibited by the lock/unlock mechanism 87 or the child lock mechanism 85 (i.e. one or both is (are) functioning as the disabling mechanism), even when the opening operation of the exterior door handle 81 or the interior door handle 82 is performed while the closing mechanism 5 operates to close the slide door 8 and displaces the fork 11 from the half latched position to the latched position, the cancel lever 60 pivots in connection with the opening operation by the cable 60C and displaces the transmitting member 50 from the engaging position to the releasing position. Therefore, as shown in FIG. 14, the engaging surface 50F stops engaging with the engaging portion 40F, and thus the transmitting member 50 allows relative displacement of the close lever 40 and the pivoting body 30. Therefore, the contactable portion 40G of the close lever 40 stops coming into contact with the contactable portion 11G of the fork 11 irrespective of the pivoting of the pivoting body 30. As a result, in the door lock apparatus 1, even if the connection of the open lever 20 with the opening operation of the exterior door handle 81 or the interior door handle 82 is prohibited, the cancel lever 60 can operate and stop the operation for closing the slide door 8 by the closing mechanism 5.

Therefore, by utilizing the representative door lock apparatus 1, it is possible to improve safety during operation of the closing mechanism 5.

In the door lock apparatus 1, the first axis X1 of the open lever 20, the second axis X2 of the pivoting body 30, the third axis X3 of the close lever 40, and the fourth axis X4 of the cancel lever 60 extend in the same direction, i.e., the vehicle in-out direction. Therefore, the door lock apparatus 1 has a reduced size as compared to an embodiment, in which the axes cross (or are skewed with respect to) one another (i.e. the axes are not parallel).

Further, by using the representative door lock apparatus 1, since the fourth axis X4 is coaxial with the first axis X1, it is possible to realize a further reduction in size as compared to an embodiment in which the fourth axis X4 is separated (spaced) from the first axis X1. In the representative door lock apparatus 1, the open lever 20 and the cancel lever 60 share the open lever support shaft 20S. Therefore, it is possible to realize a reduction in manufacturing costs due to the reduction in the number of components (i.e. a reduction of the part count).

In the representative door lock apparatus 1 as shown in, e.g., FIG. 11, since the third axis X3 is spaced farther away from the transmitting member 50 than is the second axis X2, the distance between the engaging portion 40F and the third axis X3 is larger than the distance between the engaging portion 40F and the second axis X2. Therefore, by using the representative door lock apparatus 1, it is possible to increase a lever ratio of the close lever 40 with respect to the transmitting member 50 as compared to an embodiment in which the close lever 40 is supported by the pivoting body support shaft 30S together with the pivoting body 30 and the third axis X3 is coaxial with the second axis X2. Consequently, by using the representative door lock apparatus 1, it is possible to reduce the force of the engaging portion 40F of the close lever 40, which is biased by the third torsion coil spring 40T that presses the engaging surface 50F of the transmitting member 50. As a result, by using the representative door lock apparatus 1, when the cancel lever displaces the transmitting member 50 from the engaging position to the releasing position, it is possible to reduce the frictional force acting between the engaging surface 50F and the engaging portion 40F. Therefore, it is possible to reduce the operation force of the cancel lever 60.

Further, in the representative door lock apparatus 1 as shown in FIG. 9, the open lever 20 is adjacent to the cancel lever 60, which displaces the transmitting member 50 to the releasing position, from the opposite side of the transmitting member 50 a small space apart from the cancel lever 60 and is capable of pivoting in the same direction as the cancel lever 60 in connection with the opening operation. Consequently, in the representative door lock apparatus 1, even if the cancel lever 60 cannot pivot in connection with the opening operation because of breakage of the cable 60C, which couples the remote controller unit 3 to the cancel lever 60, the open lever 20 pivots in connection with the opening operation only when the lock/unlock mechanism 87 or the child lock mechanism 85 do not prohibit the connection of the open lever 20 with the opening operation. The open lever 20 can come into contact with the intermediate portion of the cancel lever 60, to which the cable 60C is coupled, cause the cancel lever 60 to pivot, and displace the transmitting member 50 to the releasing position. As a result, by using the representative door lock apparatus 1, it is possible to further improve safety during operation of the closing mechanism 5.

A representative embodiment of the present teachings was explained above. However, the present invention is not limited by the described embodiment and various modifications of the present teachings are possible without departing from the spirit or scope of the present invention.

For example, in the representative embodiment, the pivoting body 30 is pivotably supported by the pivoting body support shaft 30S and the close lever 40 is pivotably supported by the close lever support shaft 40S. However, the present invention is not limited by this configuration. For example, the close lever support shaft 40S may be removed. In this case, the close lever 40 may be pivotably supported by the pivoting body support shaft 30S together with the pivoting body 30.

In the representative embodiment, the cancel lever 60 is pivotably supported by the open lever support shaft 20S together with the open lever 20. However, the present invention is also not limited to this configuration. For example the cancel lever 60 may be pivotably supported by a support shaft different from the open lever support shaft 20S.

In the representative embodiment, the transmitting member 50 is provided in the pivoting body 30. However, the present invention is also not limited to this configuration. For example, the transmitting member 50 may be provided in the close lever 40.

INDUSTRIAL APPLICABILITY

The present teachings can be used in a variety of fields, but are particularly preferred in the field of vehicles such as automobiles, buses, and industrial vehicle, e.g., trucks, etc.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved vehicle door lock apparatuses and methods of making and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

1 . . . Vehicle door lock apparatus
8 . . . Door (Slide door)
9 . . . Vehicle body
99 . . . Striker
97 . . . Entrance opening
90 . . . Base member
11 . . . Fork
12 . . . Pawl
81, 82 . . . Door handles (81 . . . Exterior door handle, 82 . . . Interior door handle)
20 . . . Open lever
85, 87 . . . Disabling mechanism (85 . . . Child lock mechanism, 87 . . . Lock/unlock mechanism)
5 . . . Closing mechanism
M1 . . . Driving source
30 . . . Pivoting body
40 . . . Close lever
50 . . . Transmitting member
60 . . . Cancel lever
X1 . . . First axis
X2 . . . Second axis
X3 . . . Third axis
X4 . . . Fourth axis

We claim:

1. A vehicle door lock apparatus comprising:

a base member configured to be provided in or on one of a door and a vehicle body, the base member including an entry opening configured to receive a striker fixed to the other of the door and the vehicle body;

a fork provided in or on the base member, the fork being displaceable to a latched position, where the fork locks the striker on a depth side of the entry opening, to a half latched position, where the fork locks the striker halfway in the entry opening, and to an unlatched position where the fork does not lock the striker in the entry opening;

a pawl provided in or on the base member, the pawl being configured to selectively fix the fork or to allow displacement of the fork;

an open lever pivotably supported about a first axis by the base member, the open lever being configured to act on the pawl in connection with an opening operation of a door handle to shift the pawl to a position allowing the displacement of the fork;

a closing mechanism configured to act on the fork when the fork is disposed in the half latched position and to displace the fork to the latched position; and a disabling mechanism operably provided between the door handle and the open lever and configured to selectively prohibit operation of the open lever with the opening operation, wherein the closing mechanism includes:

a driving source configured to generate a driving force;

a pivoting body pivotably supported by the base member about a second axis parallel to the first axis, the pivoting body being drivable by the driving source to pivot when the fork is disposed in the half latched position;

a close lever pivotably supported by the pivoting body about a third axis that is parallel to or coaxial with the second axis;

a transmitting member provided in or on one of the pivoting body and the close lever, the transmitting member being displaceable between an engaging position, where the transmitting member engages with the other of the pivoting body and the close lever and regulates relative displacement of the close lever and the pivoting body, and a releasing position, where the transmitting member stops engaging with the other of the pivoting body and the close lever and allows the relative displacement; and a cancel lever pivotably supported by the base member about a fourth axis that is parallel to or coaxial with the first axis, the cancel lever being pivotable in connection with the opening operation independently of the open lever and being configured to displace the transmitting member from the engaging position to the releasing position, and wherein the close lever is configured to come into contact with the fork when the fork is disposed in the half latched position through the pivoting of the pivoting body and to displace the fork to the latched position when the transmitting member is disposed in the engaging position and, alternately, to not come into contact with the fork irrespective of the pivoting of the pivoting body when the transmitting member is disposed in the releasing position.

2. The vehicle door lock apparatus according to claim 1, wherein the fourth axis is coaxial with the first axis.

3. The vehicle door lock apparatus according to claim 2, wherein the third axis is spaced farther from the transmitting member than is the second axis.

4. The vehicle door lock apparatus according to claim 3, wherein the open lever is adjacent to the cancel lever, which is configured to displace the transmitting member to the releasing position, from an opposite side of the transmitting member and is pivotable in a same direction as the cancel lever in connection with the opening operation.

5. The vehicle door lock apparatus according to claim 1, wherein the third axis is spaced farther from the transmitting member than is the second axis.

6. The vehicle door lock apparatus according to claim 1, wherein the open lever is adjacent to the cancel lever, which is configured to displace the transmitting member to the releasing position, from an opposite side of the transmitting member and is pivotable in a same direction as the cancel lever in connection with the opening operation.

7. A vehicle door lock apparatus comprising:

a base member configured to be mounted in or on one of a door and a vehicle body, the base member defining an entry opening that is shaped to receive a striker fixed to the other of the door and the vehicle body;

a fork pivotably mounted on the base member, the fork being pivotable from a latching position, where the fork locks the striker against a bottom side of the entry opening, to a half latched position, where the fork locks the striker halfway in the entry opening, and further to an unlatched position, where the fork does not lock the striker in the entry opening such that the striker is removable from the entry opening;

a pawl pivotably mounted on the base member, the pawl being configured to pivot between a first position that prevents pivoting of the fork and a second position that permits pivoting of the fork;

an open lever supported on the base member so as to be pivotable about a first axis, the open lever being configured to act on the pawl in response to an opening operation of a door handle to shift the pawl to the second position;

a disabling mechanism operably provided between the door handle and the open lever and configured to selectively prohibit the open lever from operating during the opening operation; and a closing mechanism configured to act on the fork when the fork is disposed in the half latched position to pivot the fork to the latched position, wherein the closing mechanism includes:

a driving source configured to generate a driving force;

a pivoting body supported on the base member so as to be pivotable about a second axis that is parallel to the first axis, the pivoting body being drivable by the driving source to pivot when the fork is disposed in the half latched position;

a close lever supported on the pivoting body so as to be pivotable about a third axis that is parallel to or coaxial with the second axis;

a transmitting member connected to one of the pivoting body and the close lever, the transmitting member being displaceable between an engaging position, where the transmitting member engages with the other of the pivoting body and the close lever and controls displacement of the close lever relative to the pivoting body, and a releasing position, where the transmitting member stops engaging with the other of the pivoting body and the close lever and allows the displacement of the close lever relative to the pivoting body; and a cancel lever supported on the base member so as to be pivotable about a fourth axis that is coaxial with the first axis, the cancel lever being pivotable in response to the opening operation independently of the open lever and being configured to displace the transmitting member from the engaging position to the releasing position, wherein the close lever is configured to come into contact with the fork when the fork is disposed in the half latched position through the pivoting of the pivoting body and to pivot the fork to the latched position when the transmitting member is disposed in the engaging position and, alternately, to not come into contact with the fork irrespective of the pivoting of the pivoting body when the transmitting member is disposed in the releasing position, and the third axis is spaced farther from the transmitting member than is the second axis.

8. The vehicle door lock apparatus according to claim 7, wherein the open lever is adjacent to the cancel lever, which is configured to displace the transmitting member to the releasing position, from an opposite side of the transmitting member and is pivotable in a same direction as the cancel lever in connection with the opening operation.

* * * * *